US011059655B2

(12) United States Patent
Taber et al.

(10) Patent No.: US 11,059,655 B2
(45) Date of Patent: Jul. 13, 2021

(54) CONTAINER INCLUDING AN OUTER SHELL AND CARTRIDGE, AND METHOD OF ASSEMBLING SAME

(71) Applicant: WM. WRIGLEY JR. COMPANY, Chicago, IL (US)

(72) Inventors: Benjamin Jordan Taber, Chicago, IL (US); Christopher H. Cunningham, Grays Lake, IL (US); Paul J. Angeloni, Chicago, IL (US)

(73) Assignee: WM. WRIGLEY JR. COMPANY, Chicago, IL (US)

( * ) Notice: Subject to any disclaimer, the term of this patent is extended or adjusted under 35 U.S.C. 154(b) by 26 days.

(21) Appl. No.: 16/605,410

(22) PCT Filed: May 3, 2018

(86) PCT No.: PCT/US2018/030850

§ 371 (c)(1),
(2) Date: Oct. 15, 2019

(87) PCT Pub. No.: WO2018/204616

PCT Pub. Date: Nov. 8, 2018

(65) Prior Publication Data

US 2020/0055660 A1 Feb. 20, 2020

Related U.S. Application Data

(60) Provisional application No. 62/501,557, filed on May 4, 2017.

(51) Int. Cl.
*B65D 83/04* (2006.01)

(52) U.S. Cl.
CPC ..... *B65D 83/0481* (2013.01)

(58) Field of Classification Search
CPC ..... B65D 83/0481
See application file for complete search history.

(56) References Cited

U.S. PATENT DOCUMENTS 1,904,386 A 4/1933 Raymond
4,117,952 A * 10/1978 Grimes ..... B65D 21/083 221/5

(Continued)

FOREIGN PATENT DOCUMENTS

CN 2355989 Y 12/1999
CN 101166679 A 4/2008

(Continued)

*Primary Examiner* — Gene O Crawford
*Assistant Examiner* — Ayodeji T Ojofeitimi

(57) ABSTRACT

A container includes a cartridge containing a plurality of products therein. The cartridge defines a dispensing opening. The container also includes an outer shell configured to receive the cartridge therein. The outer shell includes a dispensing end and a receiving end. The receiving end is configured to receive the cartridge therethrough. The container further includes a dispensing mechanism coupled to the outer shell dispensing end. The dispensing mechanism is movable between a first position and a second position. The dispensing mechanism in the first position obstructs the dispensing opening such that the products are retained in the container, and the dispensing mechanism in the second position enables the products to be dispensed from the container.

22 Claims, 7 Drawing Sheets

(56) References Cited

U.S. PATENT DOCUMENTS

| | | | | |
|---|---|---|---|---|
| 6,336,568 | B1 * | 1/2002 | Tucker | A47F 1/10 221/131 |
| 7,950,546 | B2 | 5/2011 | Giraud et al. | |
| 2007/0181600 | A1 | 8/2007 | Ben-Shlomo | |
| 2011/0284568 | A1 * | 11/2011 | Leifeld | B65D 83/0418 221/1 |

FOREIGN PATENT DOCUMENTS

| | | | |
|---|---|---|---|
| CN | 203168037 | U | 9/2013 |
| CN | 207390043 | U | 5/2018 |
| DE | 6922088 | U | 10/1974 |
| DE | 2922350 | A1 | 12/1980 |

* cited by examiner

CONTAINER INCLUDING AN OUTER SHELL AND CARTRIDGE, AND METHOD OF ASSEMBLING SAME

BACKGROUND

This disclosure relates generally to containers for storing and dispensing products, and more specifically, to a protective case and dispensing mechanism for an insertable cartridge containing a plurality of products, such as consumable products.

Packaging of products typically keeps the products from being damaged during shipping, keeps the products fresh, and/or in certain instances, provides the consumer with a reusable package. In instances where a package includes a plurality of product pieces and some but not all of the pieces may be consumed in one sitting, the manufacturer may wish to provide the consumer a container having a recloseable dispensing opening. Dispensing mechanisms built into these types of containers typically allow consumers to easily open the container, retrieve the consumable, and close the container, keeping the products fresh for a later use.

At least some consumers prefer emptied containers to be easily disposable, and preferably disposable in an environmentally friendly fashion. However, such disposable containers, such as a container or cartridge made of a thin paper material, are non-protective of the product. For example, if a consumer accidentally sits on a non-protective container, the products inside may become damaged and/or inconsumable. On the other hand, a more protective container typically is associated with a higher manufacturing cost and may require disposal in a less environmentally friendly fashion.

BRIEF DESCRIPTION

In one aspect, a container is provided. The container includes a cartridge containing a plurality of products therein. The cartridge defines a dispensing opening. The container also includes an outer shell configured to receive the cartridge therein. The outer shell includes a dispensing end and a receiving end. The receiving end is configured to receive the cartridge therethrough. The container further includes a dispensing mechanism coupled to the outer shell dispensing end. The dispensing mechanism is movable between a first position and a second position. The dispensing mechanism in the first position obstructs the dispensing opening such that the products are retained in the container, and the dispensing mechanism in the second position enables the products to be dispensed from the container.

In another aspect, a method of assembling a container is provided. The method includes providing a cartridge including a plurality of products therein. The cartridge defines a dispensing opening. The method also includes inserting the cartridge through a receiving end of an outer shell such that the cartridge is received within the outer shell. The outer shell further includes a dispensing end and a dispensing mechanism coupled to the outer shell dispensing end. The dispensing mechanism is movable between a first position and a second position. The dispensing mechanism in the first position obstructs the dispensing opening such that the products are retained in the container, and the dispensing mechanism in the second position enables the products to be dispensed from the container.

DETAILED DESCRIPTION

The embodiments described herein include a container. The container includes a cartridge containing a plurality of products therein, such as, but not limited to, confectionary products. The container also includes an outer shell configured to receive the cartridge therein. A dispensing mechanism coupled to the outer shell is movable between a first position, in which the products are retained within the container, and a second position, in which the products may be dispensed out of the cartridge and out of the container. In some embodiments, the cartridge may be ejected from the outer shell, and a new cartridge inserted. In some embodiments, the outer shell is reusable, while the emptied cartridge can be discarded.

It will be understood that various shapes and sizes of consumable goods or products can be stored within the container. Examples of such shapes include pill, block, flat stick, pillow, round, rectangular, triangular, and any combination of the same. In an embodiment, the products housed in the container may be confectionery products, including such non-limiting examples as hard candies, gummy candies, mints, tablets, gum pellets, beads, liquid filled beads, chewy candy, chocolate, caramels, and gumballs. In another embodiment, the products may be snack foods, including such non-limiting examples as peanuts, nuts, pretzels, and salty snacks.

The products can alternatively be any other type of solid consumable good. For instance, the products can be cough drops or breath mints or other types of medical, consumable goods. In an embodiment, the container may include combinations of products. It should also be appreciated that the container may house non-edible products of similar size and shape. The teachings of the present disclosure, however, are not dependent upon the products being any particular type as long as the products can fit within and be dispensed out of the container described herein.

Figure 1:
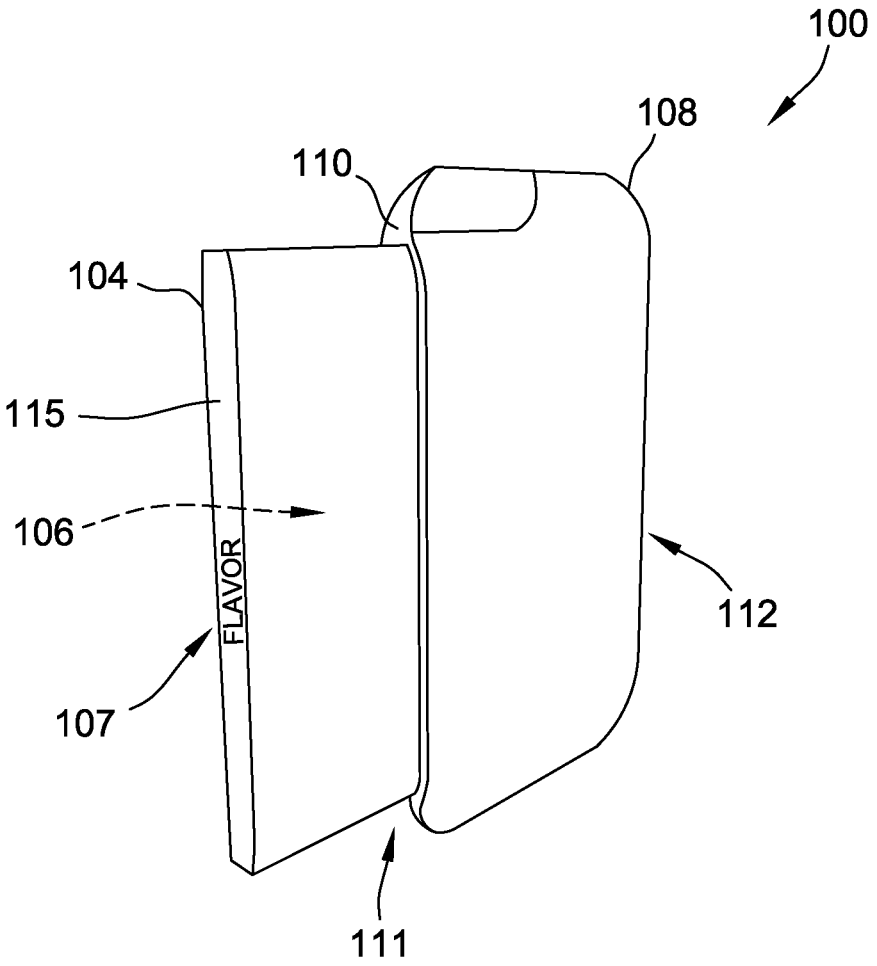
FIG. 1 is a perspective illustration of an example embodiment of a container configured to dispense products from a cartridge.
Figure 2:
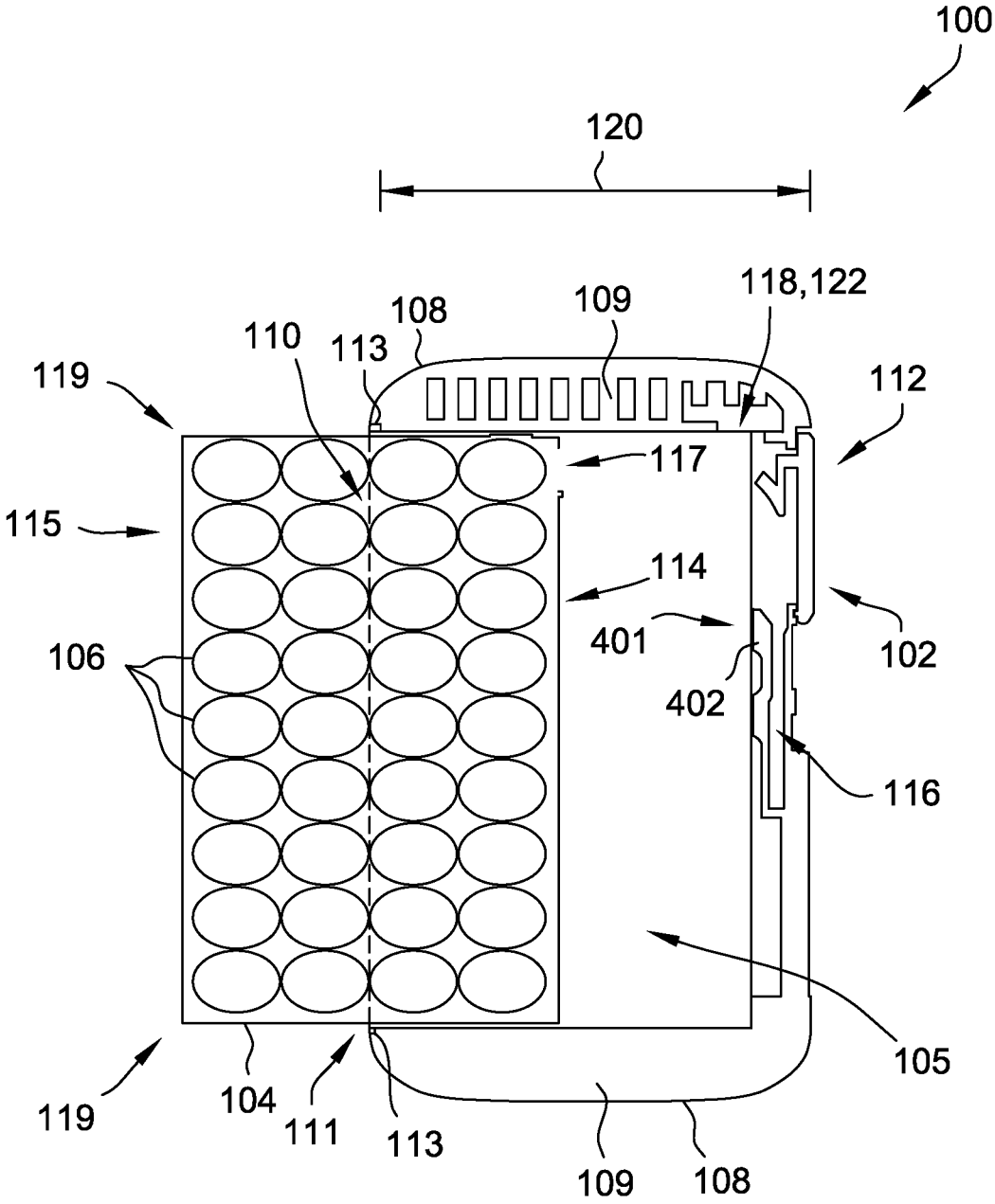
FIG. 2 is a cross-section illustration of the container shown in FIG.

FIG. 1 is a perspective illustration of an example embodiment of a container 100 configured to dispense products 106 from a cartridge 104. FIG. 2 is a cross-section illustration of container 100. In FIGS. 1 and 2, cartridge 104 is illustrated as partially received by container 100, such as during a process of inserting cartridge 104 into, or ejecting cartridge 104 from, container 100. Container 100 includes an outer shell 108 configured to receive cartridge 104 therein. Container 100 may be any suitable size or shape, including but not limited to cubic, rectangular, pyramidal, cylindrical, conical, spherical, and combinations thereof. In the example embodiment, products 106 are inserted into cartridge 104 prior to insertion of cartridge 104 into outer shell 108.

In certain embodiments, outer shell 108 is formed from a material suitably configured to protect cartridge 104. In the example embodiment, outer shell 108 is formed from a plastic material. Alternatively outer shell is formed from another protective material, such as, but not limited to, metallic and/or silicone-based materials. Protection of cartridge 104 includes, but is not limited to, protection of cartridge 104 from at least one of physical damage, water damage, excessive heat, excessive cold, and dust. In alternative embodiments, outer shell 108 is formed from any suitable material.

In the example embodiment, container 100 includes suitable graphics (not shown), such as, but not limited to, visual designs or text, on an exterior portion of outer shell 108 that is visible to a user/consumer. In some embodiments, outer shell 108 formed separately from cartridge 104 enables cartridges 104 of products 106 produced in a single packaging process to be carried in a variety of structurally similar containers 100 characterized by graphics personalized for different consumers. For example, a plurality of identical outer shells 108 is formed from a plastic material, and a wide variety of different graphics are separately formed on suitable patterns (not shown), such as formed from tin or another suitable material. The patterns may be glued or otherwise coupled to the plastic outer shells by way of hand or by an at least partially automated process. Alternatively, each pattern is coupled to one of the plastic outer shells 108 by fusing the plastic outer shell 108 to the metal pattern. Materials configured to withstand high temperatures and/or harsh environments may be suitable for this process. For example, the pattern is placed in an outer shell mold, either by hand or automation, before molten plastic material is injected into the mold to form outer shell 108. In some embodiments, as the molten plastic material flows into undercut features in the pattern, the pattern is anchored to outer shell 108 much more securely as compared to coupling the pattern to a previously molded outer shell 108.

Outer shell 108 includes a receiving end 110 that defines a receiving opening 111 sized to receive cartridge 104 at least partially therethrough. Outer shell 108 also includes a dispensing end 112 configured to enable dispensing of products 106 from container 100. In the example embodiment, dispensing end 112 is positioned opposite receiving end 110, such that cartridge 104 is insertable into, and removable from, one side of outer shell 108 and products 106 are dispensed from the opposite side. In alternative embodiments, dispensing end 112 is positioned in any suitable relationship to receiving end 110. A dispensing mechanism 102 is coupled to outer shell 108 at dispensing end 112. Dispensing mechanism 102 generally facilitates opening and closing container 100.

Cartridge 104 includes a dispensing end 114 configured to be positioned adjacent to outer shell dispensing end 112 when cartridge 104 is received in container 100. Cartridge dispensing end 114 includes a dispensing opening 117 defined therein and extending therethrough. More specifically, cartridge 104 is sized and shaped to be positioned within outer shell 108 such that dispensing opening 117 of cartridge 104 aligns with dispensing mechanism 102 of outer shell 108. Thus, products 106 may be dispensed from an interior of cartridge 104, through dispensing opening 117, through dispensing mechanism 102, and out of container 100. In the example embodiment, opening 117 is initially securely closed by a closure 500, such as a tab 502 (shown in FIG. 6) or perforation, to prevent dispensing of products 106 prior to insertion of cartridge 104 within container 100. For example, a consumer directly removes tab 502 or otherwise opens closure 500 in conjunction with inserting cartridge 104 into container 100. Alternatively, dispensing mechanism 102 is configured to remove tab 502 or otherwise open closure 500, as will be described below.

Cartridge 104 includes a display end 115 configured to be positioned adjacent to outer shell receiving end 110 when cartridge 104 is received in container 100. In the example embodiment, outer shell receiving opening 111 remains uncovered after cartridge 104 is inserted, such that cartridge display end 115 is visible to the consumer via opening 111 after cartridge 104 is inserted into container 100. In some such embodiments, cartridge display end 115 includes indicia 107. For example, indicia 107 may include graphics and/or text associated with products 106, such as a printed brand and/or flavor. In alternative embodiments, outer shell 108 includes a cover, such as but not limited to a hinged door (not shown) coupled to receiving end 110, that is closeable over receiving opening 111 after cartridge 104 is inserted through receiving opening 111.

In certain embodiments, container 100 further includes a core 109 coupled to outer shell 108. Core 109 and outer shell 108 cooperate to define an interior 105 of container 100, and cartridge 104 is sized and shaped to be snugly received within interior 105. Moreover, in some such embodiments, core 109 is configured to secure cartridge 104 within outer shell 108. For example, core 109 may be configured to secure cartridge 104 after insertion in a suitable snap fit relationship. For example, the snap fit may be engaged when cartridge dispensing end 114 is advanced proximate to outer shell dispensing end 112, such that a consumer inserting cartridge 104 from receiving end 110 towards outer shell dispensing end 112 receives tactile feedback and/or hears a click or snap when the snap fit is engaged, indicating to the consumer that sufficient force has been applied for the securing of cartridge 104. In some embodiments, core 109 includes at least one resilient detent 113 adjacent to outer shell receiving end 110 and configured to facilitate the snap fit. Each detent 113 is configured to retain a respective corner 119 of display end 115 of cartridge 104 after cartridge 104 is inserted through receiving end 110.

For another example, core 109 includes grooves (not shown) defined on an interior of container 100 that cooperate with corresponding ridges (not shown) included on an exterior of cartridge 104 to facilitate a secure fit. For another example, in the example embodiment, core 109 includes a retention spring 122 configured to facilitate retaining inserted cartridge 104 within container 100. In some embodiments, retention spring 122 is implemented as an angled spring 408 (shown in FIG. 5), as will be described below. In alternative embodiments, container 100 includes any suitable securing mechanism for cartridge 104, including, but not limited to, an external cover (not shown) coupled to outer shell 108 and closeable over receiving opening 111.

Figure 3:
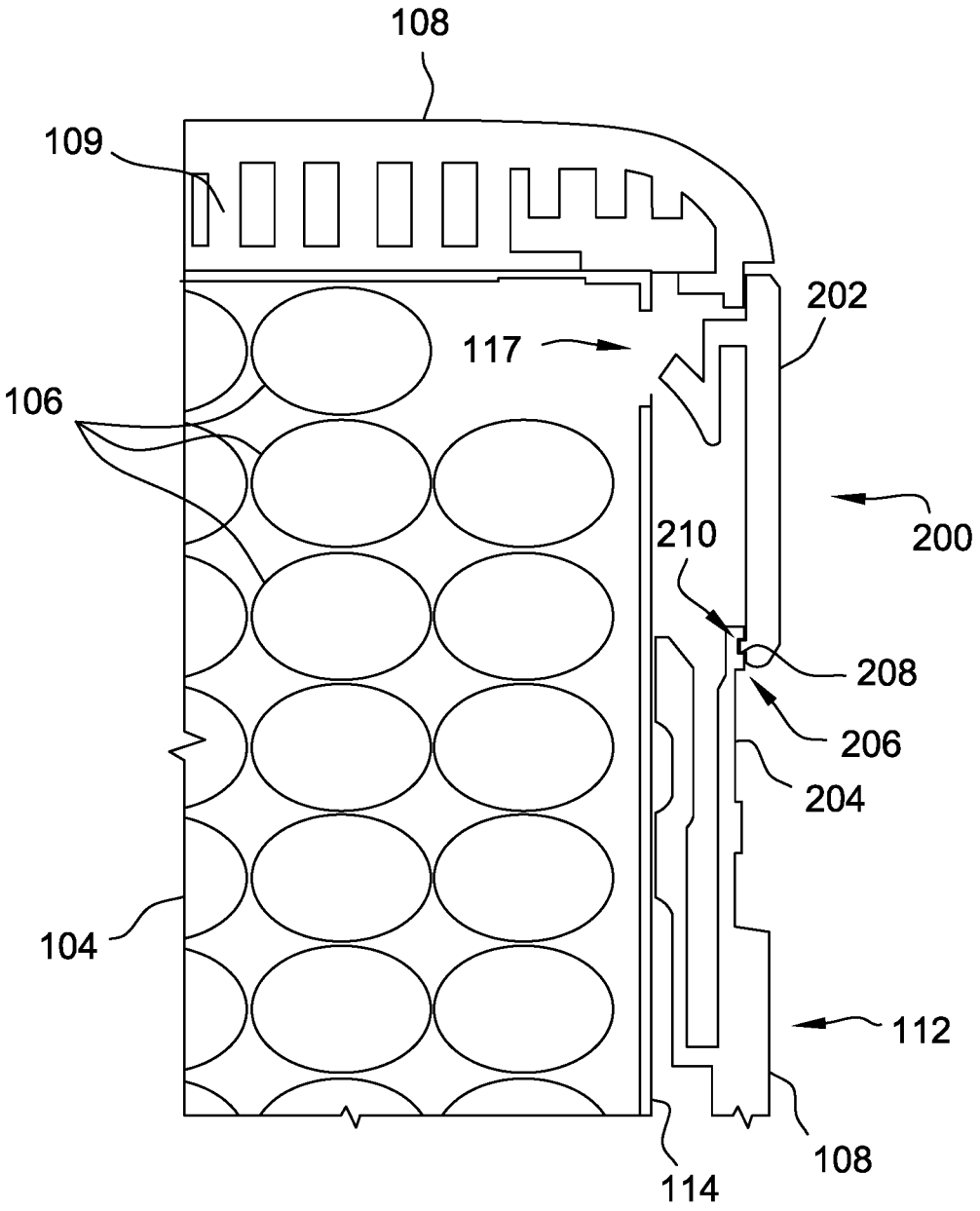
FIG. 3 is a cross-section illustration of a portion of the container shown in FIG. 1 showing a dispensing mechanism in a first, closed position.
Figure 4:
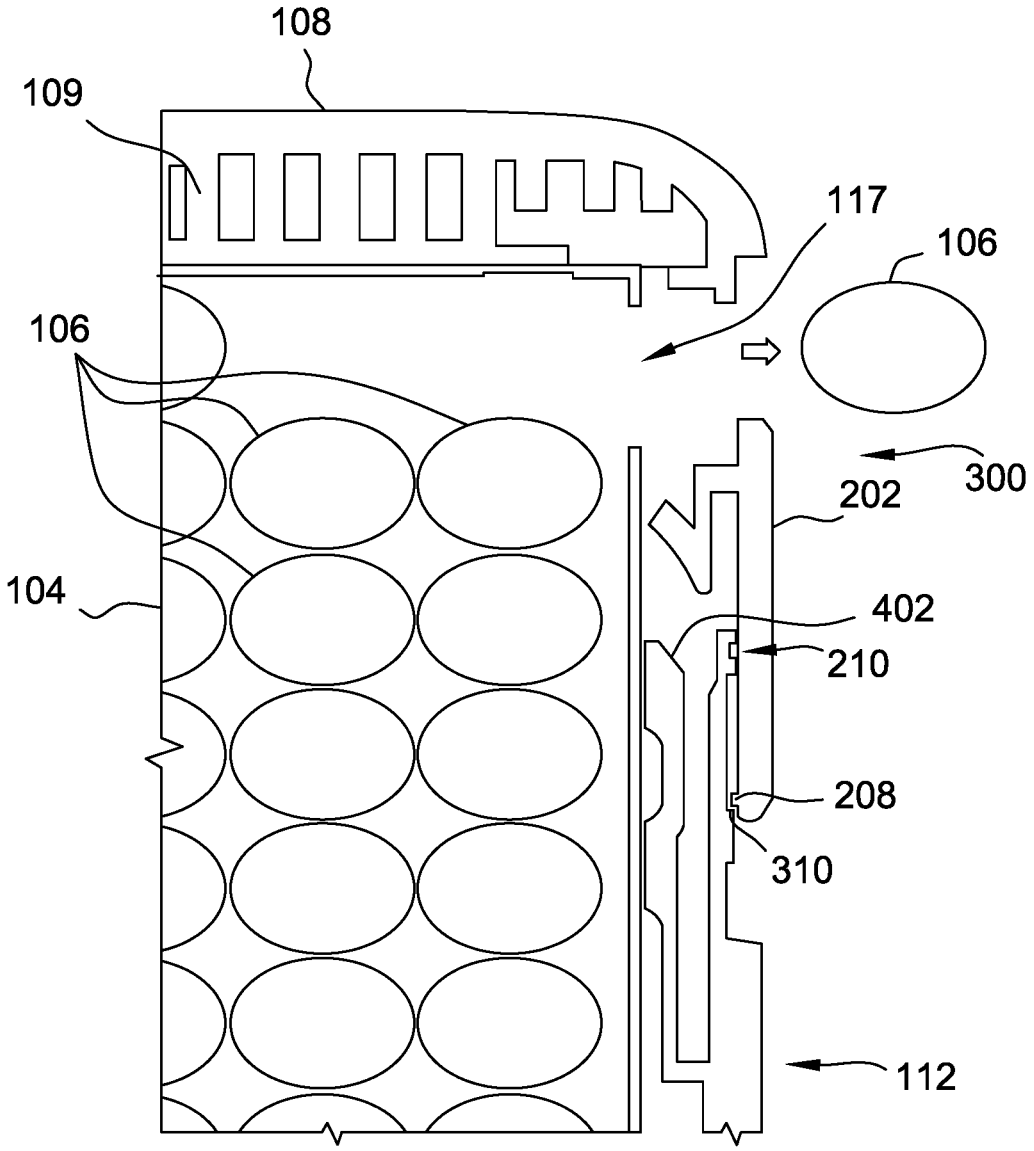
FIG. 4 is a cross-section illustration of a portion of the container shown in FIG. 1 showing the dispensing mechanism in a second, dispensing position.

FIG. 3 is an illustration of container 100 showing dispensing mechanism 102 in a first, closed position 200. FIG. 4 is an illustration of container 100 showing dispensing mechanism in a second, dispensing position 300. In first position 200, dispensing mechanism 102 obstructs dispensing opening 117 such that products 106 are retained in container 100. In second position 300, dispensing mechanism 102 enables products 106 to be dispensed through dispensing opening 117 and out of container 100. For example, with dispensing mechanism 102 in second position 300, a consumer is able to retrieve or dispense products 106 by tilting or shaking container 100 in a manner that encourages products 106 from cartridge 104 to pass through opening 117, past dispensing mechanism 102, and out of container 100.

Dispensing mechanism 102 includes a gate 202 coupled to outer shell 108 for movement with respect to outer shell dispensing end 112. More specifically, movement of gate 202 transitions dispensing mechanism 102 between first position 200 and second position 300. In the example embodiment, gate 202 is coupled to outer shell dispensing end 112 and configured to slide parallel to outer shell dispensing end 112 between first position 200 and second position 300. For example, outer shell dispensing end 112 includes grooves (not shown) suitably shaped and sized to cooperate with sliding motion of gate 202 parallel to dispensing end 112. Gate 202 slides into an adjacent relationship with dispensing opening 117 to orient dispensing mechanism 102 in first position 200, and slides into a vertically (with respect to the view of FIG. 4) displaced relationship with dispensing opening 117 to orient dispensing mechanism 102 in second, dispensing position 300. In alternative embodiments, gate 202 is coupled to outer shell 108 in any suitable fashion, and for any suitable type and direction of movement, with respect to outer shell dispensing end 112 that enables dispensing mechanism 102 to function as described herein.

In some embodiments, dispensing mechanism 102 further includes a retention mechanism 206 configured to releasably retain dispensing mechanism 102, and more specifically gate 202, in first position 200. For example, in the example embodiment, the retention mechanism includes a key 208 coupled to gate 202. Key 208 is shaped and sized to cooperate with a slot 210 defined on outer shell dispensing end 112. More specifically, key 208 is received in slot 210 when dispensing mechanism 102 is in first position 200, such that slot 210 exerts a retention force on key 208. Key 208 and slot 210 are configured to decouple in response to a sufficient amount of force applied to sliding member 200 by a consumer, enabling movement of dispensing mechanism 102 to second position 300. In alternative embodiments, retention mechanism 206 includes any suitable structure that enables dispensing mechanism 102 to function as described herein.

In certain embodiments, dispensing mechanism 102 also includes a stop 310 configured to obstruct dispensing mechanism 102, and more specifically gate 202, from moving beyond second position 300. In the example embodiment, stop 310 does not obstruct a return of gate 202 from second, dispensing position 300 to first, closed position 200. For example, in the example embodiment, stop 310 protrudes laterally outward from outer shell dispensing end 112, such that stop 310 interferes with key 208 if a consumer attempts to move gate 202 from first position 200 past second position 300 to a location beyond second position 300. Moreover, if a consumer attempts to move gate 202 beyond second position 300, the consumer receives force feedback from the contact between key 208 and stop 310, indicating that gate 202 has been moved sufficiently to open container 100. In alternative embodiments, gate 202 and stop 310 are configured to cooperate in any suitable fashion to obstruct gate 202 from moving beyond second position 300. In alternative embodiments, dispensing mechanism 102 does not include stop 310.

In some embodiments, dispensing mechanism 102 is selectively movable beyond second position 300 to a third, ejection position 400 (shown in FIG. 5), as described below. Moreover, in some such embodiments, key 208 and stop 310 are configured such that key 208 resiliently moves past stop 310 in response to a greater exertion of force, enabling a consumer to selectively move dispensing mechanism 102 beyond second position 300 to third position 400. In alternative embodiments, dispensing mechanism is not configured to be movable beyond second position 300, and key 208 and stop 310 are configured to inhibit key 208 from moving past stop 310 in response to greater exertion of force.

Figure 5:
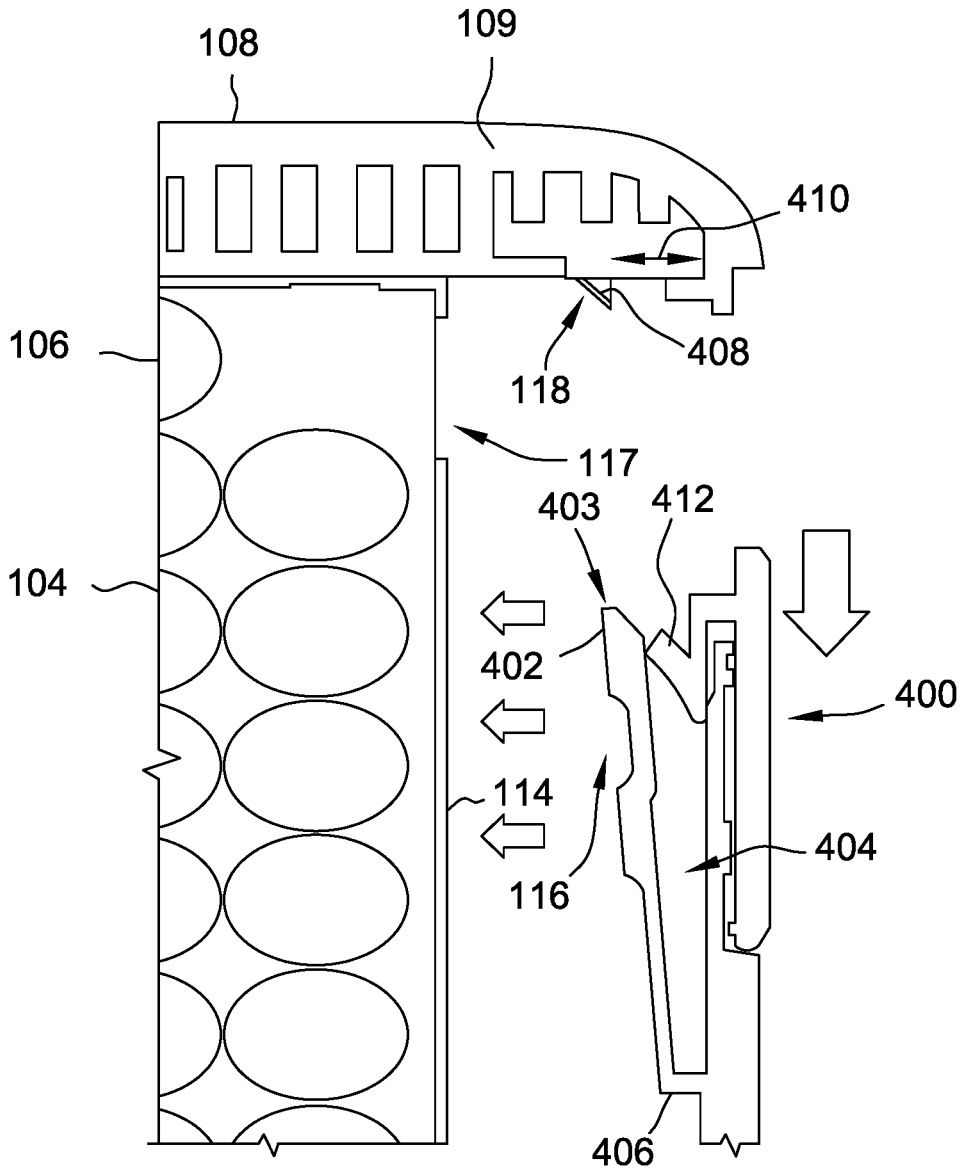
FIG. 5 is a cross-section illustration of a portion of the container shown in FIG. 1 showing the dispensing mechanism in a third, ejection position.

FIG. 5 is an illustration of container 100 showing dispensing mechanism 102 in third, ejection position 400. With reference to FIGS. 2 and 5, in the example embodiment, container 100 includes an ejection mechanism 116 coupled to outer shell 108, and dispensing mechanism 102 in third position 400 is configured to cooperate with ejection mechanism 116 to eject cartridge 104 from container 100. More specifically, movement of dispensing mechanism 102 into third position 400 causes ejection mechanism 116 to bear against cartridge 104 and urge cartridge 104 at least partially back through receiving opening 111 of outer shell 108. For example, but not by way of limitation, in response to cartridge 104 becoming empty of products 106, a consumer selectively moves dispensing mechanism 102 to third position 400 such that ejection mechanism 116 pushes cartridge 104 at least partially out of container 100. The consumer grasps the exposed portion of cartridge 104, pulls cartridge 104 out of outer shell 108, discards cartridge 104, and inserts a replacement cartridge 104 into outer shell 108 as described above.

In certain embodiments, ejection mechanism 116 includes an ejection arm 402 coupled to outer shell dispensing end 112, and positioned between outer shell dispensing end 112 and cartridge dispensing end 114. More specifically, ejection arm 402 is moveable with respect to dispensing end 112 between a first orientation 401 adjacent to outer shell dispensing end 112 (as shown in FIGS. 2-4) and a second orientation 403 extending interiorly from outer shell dispensing end 112 (as shown in FIG. 5). In first orientation 401, ejection arm 402 does not interfere with cartridge 104 received within container 100, and in second orientation 403, ejection arm 402 interferes with cartridge 104 received within container 100, such that ejection arm 402 urges cartridge 104 at least partially out of container 100. Moreover, dispensing mechanism 102 in third position 400 is configured to move ejection arm 402 from first orientation 401 to second orientation 403.

For example, in the example embodiment, ejection arm 402 is a flexible member coupled to outer shell dispensing end 112 at a cantilever joint 406, such that a gap 404 is defined between ejection arm 402 and outer shell dispensing end 112. Dispensing mechanism 102 cooperates with ejection mechanism 116 via a tapered finger 412 coupled to an interior side of gate 202. Finger 412 is positioned to move into gap 404 in a wedge-like fashion and bear against ejection arm 402 as gate 202 is moved from second position 300 to third position 400. More specifically, finger 412 is sized and shaped to urge flexible ejection arm 402 progressively interiorly away from outer shell dispensing end 112. As ejection arm 402 is urged away from outer shell dispensing end 112, it exerts an ejection force on cartridge 104, causing cartridge 104 to move at least partially out of container 100. In alternative embodiments, ejection mechanism 116 includes any suitable structure, and/or dispensing mechanism 102 is configured to cooperate with ejection mechanism 116 in any suitable fashion, that enables ejection mechanism 116 to function as described herein.

In some embodiments, as described above, core 109 is configured to secure cartridge 104 within outer shell 108 after insertion, such as via at least one resilient detent 113. In some such embodiments, ejection mechanism 116 is configured to overcome the securing force when dispensing mechanism 102 is moved to third position 400. For example, in the example embodiment, resilient detent 113 is configured to resiliently yield to an ejection force exerted by finger 412 in response to a consumer urging gate 202 over stop 310 and into third position 400. Additionally or alternatively, container 100 includes a secondary ejection mechanism 118 configured to increase an ejection force applied to cartridge 104.

For example, in the example embodiment, ejection mechanism 116 functions as a primary ejection mechanism, and secondary ejection mechanism 118 includes a suitable angled spring 408 coupled to core 109 at a distance 410 from outer shell dispensing end 112. Distance 410 is small compared to a width 120 defined between outer shell dispensing end 112 and receiving end 110. Angled spring 408 is configured to be compressed by cartridge dispensing end 114 as cartridge 104 is inserted into container 100. In the compressed state, angled spring 408 is compressed into a shape generally parallel to width 120 and exerts a force transverse to a direction of insertion of cartridge 104, which tends to secure cartridge 104 against container 100, such that angled spring 408 functions as retention spring 122 described above. When primary ejection mechanism 116 moves cartridge dispensing end 114 interiorly from outer shell dispensing end 112 over the distance 410, angled spring 408 transitions from the compressed state to an expanded state (shown in FIG. 5) as cartridge dispensing end 114 passes underneath. In the expanded state, the spring force exerted by angled spring 408 on cartridge dispensing end 114 urges the cartridge 104 towards receiving end 110. In some embodiments, the angled spring 408 is configured to urge the cartridge 104 towards the receiving end 110 after the primary ejection mechanism 116 moves the cartridge 104 over the entire distance 410. In other embodiments, the angled spring 408 is configured to urge the cartridge 104 towards the receiving end 110 even before the primary ejection mechanism 116 moves the cartridge 104 over the entire distance 410. Thus, angled spring 408 can increase or supplement the ejection force applied to cartridge 104 by primary ejection mechanism 116. In alternative embodiments, secondary ejection mechanism 118 includes any suitable structure that enables secondary ejection mechanism 118 to function as described herein. In other alternative embodiments, container 100 does not include secondary ejection mechanism 118.

Figure 6:
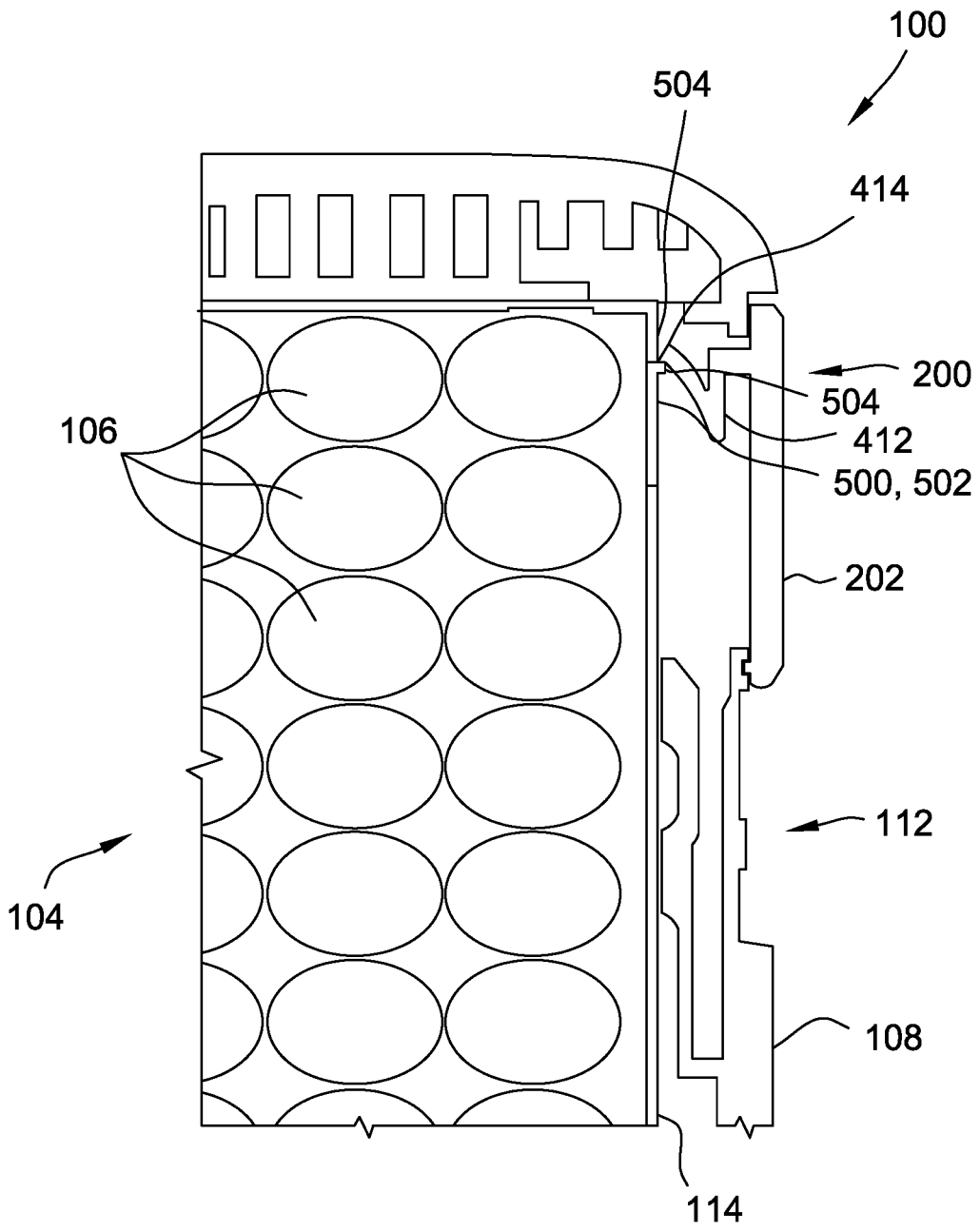
FIG. 6 is a cross-section illustration of a portion of the container shown in FIG. 1 with the dispensing mechanism in the first, closed configuration and a closure over a dispensing opening of the cartridge.
Figure 7:
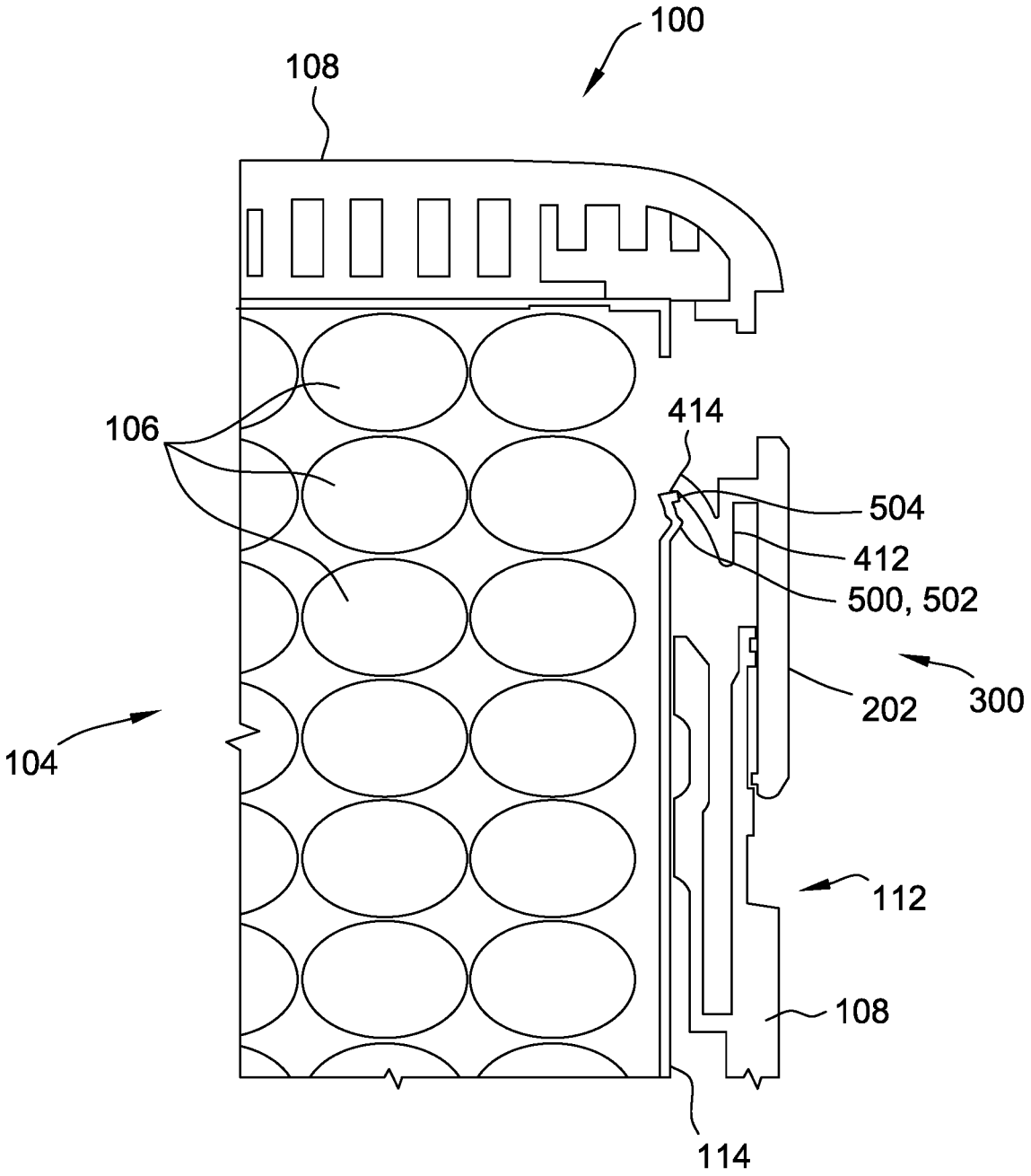
FIG. 7 is a cross-section illustration of the container shown in FIG. 1, with the dispensing mechanism in the second, dispensing position and the closure removed from the dispensing opening.

FIG. 6 is an illustration of container 100 with dispensing mechanism 102 in first, closed configuration 200 and cartridge 114 including a closure 500 over dispensing opening 117. For example, cartridge 104 is not yet opened for the first time. FIG. 7 is an illustration of container 100 with dispensing mechanism 102 in second, dispensing position 300 and closure 500 removed from dispensing opening 117. More specifically, in the example embodiment, finger 412 of dispensing mechanism 102 is configured to engage closure 500 as dispensing mechanism 102 is moved from first position 200 to second position 300, such that closure 500 is removed from dispensing opening 117. As such, cartridge 104 is opened, enabling passage of products 106 through dispensing opening 117, without requiring a consumer to directly interact with closure 500.

For example, in the example embodiment, finger 412 includes an extended tip 414 that projects interiorly from dispensing mechanism 102 proximate to closure 500, and closure 500 is a tab 502 coupled to cartridge 104 such that tab 502 covers dispensing opening 117. Tab 502 includes a lip 504 projecting outwardly from cartridge 104, such that lip 504 is positioned proximate to, and slightly underneath, tip 414 when cartridge 104 is received within container 100. When gate 202 slides parallel to outer shell dispensing end 112 from first position 200 to second position 300, tip 414 engages lip 504 and pulls tab 502 downward, at least partially decoupling tab 502 from cartridge 104 and exposing dispensing opening 117.

In alternative embodiments, closure 500 is any suitable structure, and dispensing mechanism 102 includes any structure suitably configured to engage closure 500, that enables container 100 to function as described herein. For example, closure 500 is as a perforation (not shown) in cartridge 104, and tip 414 is configured to tear the perforation as gate 202 is moved from first position 200 to second position 300.

Although specific features of various embodiments of the invention may be shown in some drawings and not in others, this is for convenience only. Moreover, references to "one embodiment" in the above description are not intended to be interpreted as excluding the existence of additional embodiments that also incorporate the recited features. In accordance with the principles of the invention, any feature of a drawing may be referenced and/or claimed in combination with any feature of any other drawing.

While certain exemplary embodiments have been described and shown in the accompanying drawings, it is to be understood that such embodiments are merely illustrative of and not restrictive on the broad disclosure, and that this disclosure not be limited to the specific constructions and arrangements shown and described, since various other modifications may occur to those ordinarily skilled in the art.

What is claimed is:

1. A method of assembling a container, the method comprising:

providing a cartridge including a plurality of products therein, wherein the cartridge defines a dispensing opening; and inserting the cartridge through a receiving end of an outer shell such that the cartridge is received within the outer shell, wherein the outer shell further includes a dispensing end and a dispensing mechanism coupled to the outer shell dispensing end, the dispensing mechanism movable between a first position and a second position, wherein the dispensing mechanism in the first position obstructs the dispensing opening such that the products are retained in the container, and the dispensing mechanism in the second position enables the products to be dispensed from the container, and wherein the dispensing mechanism is further movable to a third position and an ejection mechanism urges the cartridge out of the receiving end of the outer shell when the dispensing mechanism is in the third position.

2. The method according to claim 1, wherein the container further includes a core coupled to the outer shell, and inserting the cartridge comprises inserting the cartridge such that the core secures the cartridge in a snap fit.

3. The method according to claim 1, wherein inserting the cartridge comprises inserting the cartridge into the outer shell including the outer shell dispensing end opposite the receiving end.

4. A container comprising:

a cartridge containing a plurality of products therein, the cartridge defining a dispensing opening;

an outer shell configured to receive the cartridge therein, the outer shell comprising a dispensing end and a receiving end, the receiving end configured to receive the cartridge therethrough; and a dispensing mechanism coupled to the outer shell dispensing end, the dispensing mechanism movable between a first position and a second position, wherein the dispensing mechanism in the first position obstructs the dispensing opening such that the products are retained in the container, and the dispensing mechanism in the second position enables the products to be dispensed from the container; and a core coupled to the outer shell, wherein the core and the outer shell cooperate to define an interior of the container, and the cartridge is sized and shaped to be snugly received within the interior, and wherein the core comprises a retention spring configured to secure the cartridge.

5. A container comprising:

a cartridge containing a plurality of products therein, the cartridge defining a dispensing opening;

an outer shell configured to receive the cartridge therein, the outer shell comprising a dispensing end and a receiving end, the receiving end configured to receive the cartridge therethrough;

a dispensing mechanism coupled to the outer shell dispensing end, the dispensing mechanism movable between a first position and a second position, wherein the dispensing mechanism in the first position obstructs the dispensing opening such that the products are retained in the container, and the dispensing mechanism in the second position enables the products to be dispensed from the container; and a closure over the dispensing opening, and wherein the dispensing mechanism is configured to engage the closure as the dispensing mechanism is moved from the first position to the second position, such that the closure is removed from the dispensing opening.

6. A container comprising:

a cartridge containing a plurality of products therein, the cartridge defining a dispensing opening;

an outer shell configured to receive the cartridge therein, the outer shell comprising a dispensing end and a receiving end, the receiving end configured to receive the cartridge therethrough;

a dispensing mechanism coupled to the outer shell dispensing end, the dispensing mechanism movable between a first position and a second position, wherein the dispensing mechanism in the first position obstructs the dispensing opening such that the products are retained in the container, and the dispensing mechanism in the second position enables the products to be dispensed from the container; and an ejection mechanism coupled to the outer shell, wherein the dispensing mechanism is movable to a third position and the ejection mechanism urges the cartridge out of the receiving end of the outer shell when the dispensing mechanism is in the third position.

7. The container according to claim 6, wherein the outer shell dispensing end is opposite the receiving end.

8. The container according to claim 6, wherein the cartridge is sized and shaped to be positioned within the outer shell such that the dispensing opening of the cartridge aligns with the dispensing mechanism.

9. The container according to claim 6, wherein the dispensing mechanism further comprises a retention mechanism configured to releasably retain the dispensing mechanism in the first position.

10. The container according to claim 6, wherein the third position is disposed beyond the second position relative to the first position.

11. The container according to claim 10, wherein the dispensing mechanism further comprises a stop configured to obstruct the dispensing mechanism from moving beyond the second position.

12. The container according to claim 6, wherein the cartridge further comprises a display end configured to be positioned adjacent to the outer shell receiving end, the cartridge display end comprising indicia visible to a consumer after the cartridge is received in the outer shell.

13. The container according to claim 6, wherein the cartridge further comprises a closure over the dispensing opening, and wherein the dispensing mechanism is configured to engage the closure as the dispensing mechanism is moved from the first position to the second position, such that the closure is removed from the dispensing opening.

14. The container according to claim 6, wherein the ejection mechanism comprises an ejection arm coupled to the outer shell dispensing end and moveable between a first orientation adjacent to the outer shell dispensing end, and a second orientation extending interiorly from the outer shell dispensing end, wherein the ejection arm urges the cartridge at least partially out of the receiving end of the outer shell in the second orientation.

15. The container according to claim 14, wherein the ejection arm comprises a flexible member coupled to the outer shell dispensing end at a cantilever joint, such that a gap is defined between the ejection arm and the outer shell dispensing end, and wherein the dispensing mechanism comprises a tapered finger, the tapered finger configured to move into the gap and bear against the ejection arm and move the ejection arm from the first orientation to the second orientation as the dispensing mechanism is moved from the second position to the third position.

16. The container according to claim 6, wherein the ejection mechanism comprises a primary ejection mechanism, and the container further comprises a secondary ejection mechanism.

17. The container according to claim 16, further comprising a core coupled to the outer shell, wherein the secondary ejection mechanism comprises an angled spring coupled to the core at a distance from the outer shell dispensing end.

18. The container according to claim 6, further comprising a core coupled to the outer shell, wherein the core and the outer shell cooperate to define an interior of the container, and the cartridge is sized and shaped to be snugly received within the interior.

19. The container according to claim 18, wherein the core is configured to secure the cartridge in a snap fit.

20. The container according to claim 18, wherein the core comprises a retention spring configured to secure the cartridge.

21. The container according to claim 6, wherein the dispensing mechanism comprises a gate coupled to the outer shell dispensing end, the gate movable to transition the dispensing mechanism between the first position and the second position.

22. The container according to claim 21, wherein the gate is configured to slide parallel to the outer shell dispensing end between the first position and the second position.

* * * * *